US006444270B1

(12) United States Patent
Naruse

(10) Patent No.: US 6,444,270 B1
(45) Date of Patent: Sep. 3, 2002

(54) PHOTO FILM COATING METHOD FOR COATING WEB-SHAPED BASE MATERIAL

(75) Inventor: Yasuhito Naruse, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/620,961

(22) Filed: Jul. 21, 2000

(30) Foreign Application Priority Data

Jul. 23, 1999 (JP) ..... 11-208452

(51) Int. Cl.[7] ..... B05D 1/28; B05D 3/12

(52) U.S. Cl. ..... 427/359; 427/428; 118/110; 118/118; 118/244; 118/414

(58) Field of Search ..... 427/359, 428; 118/110, 118, 414, 244

(56) References Cited

U.S. PATENT DOCUMENTS 5,582,870 A * 12/1996 Shigesada et al. ..... 427/358
5,820,935 A * 10/1998 Kashiwabara et al. ..... 427/359
5,843,529 A * 12/1998 Peiffer ..... 427/348

FOREIGN PATENT DOCUMENTS

JP 58-4589 1/1983

* cited by examiner

*Primary Examiner*—Katherine A. Bareford
(74) *Attorney, Agent, or Firm*—Sughrue Mion, PLLC

(57) ABSTRACT

In a coating method using a coating rod, the coating rod is rotated in the reverse direction with respect to the running direction of the web, and the absolute value of $V_1/V_2$ is set between 0.0001 and 0.06, where $V_1$ (cm/sec) is a rotating speed of the rod and $V_2$ (cm/sec) is a running speed of the web.

2 Claims, 2 Drawing Sheets

PHOTO FILM COATING METHOD FOR COATING WEB-SHAPED BASE MATERIAL

BACKGROUND OF THE INVENTION

1. Field of the Invention

The present invention relates to a coating method for coating a sheet-shaped or web-shaped base material (hereinafter referred to as a "web") such as a metal sheet, paper and film with a variety of liquid substances (hereinafter referred to as "coating liquids").

2. Description of Related Art

A variety of coating apparatuses such as a roll coater, an air knife coater, a coater using a die and a rod coater are known that coat a web such as a metal sheet, paper and plastic film with a variety of coating liquids.

Among these coating apparatuses, the rod coater is widely used since it is simple and is capable of coating a variety of webs with a variety of coating liquids. There are two types of rod coaters. One removes, by means of a coating rod, a surplus of the coating liquid that has been applied on the web, and the other applies the coating liquid on the web and adjusts the amount of the coating liquid by one coating rod. In both types of the rod coaters, a number of grooves are formed on the surface of the coating rod along the circumferential direction. The amount of the coating liquid to be applied on the web and the amount of the coating liquid to be removed from the web are adjusted with the depth, width, etc. of the grooves.

In a conventional rod coater disclosed in Japanese Patent Publication No. 58-4589, the coating rod is rotated in the same direction or in the reverse direction with respect to a running direction of the continuously-running web, and the coating rod picks up the coating liquid from a pool to thereby apply the coating liquid on the web to form a coating layer on the web. In the applying, the amount of the coating liquid is measured in an area where the web becomes into contact with the rod so that only a desired amount of the coating liquid can remain on the web. The surplus of the coating liquid flows down to rejoin the pool, to which a new coating liquid is also supplied.

In the conventional coating method of Japanese Patent Publication No. 58-4589, however, "streaks at a constant pitch" are formed on the surface of the coating layer on the web if a high-speed coating is performed by raising the running speed of the web or if a coating liquid with a high viscosity is applied on the web.

To prevent the formation of the "streaks at a constant pitch", it is more preferable to rotate the coating rod in the reverse direction with respect to the running direction of the web than in the same direction. Only the reverse rotation, however, cannot completely solve the problem since "streaks at a constant pitch" of a different kind from the above-mentioned "streaks at a constant pitch" are formed.

SUMMARY OF THE INVENTION

It is therefore an object of the present invention to provide a coating method that enables a satisfactory coating without forming the streaks if the high-speed coating is performed by raising the running speed of the web or if the web is coated with the coating liquid with a high viscosity.

The above object can be accomplished by providing a coating method for coating a continuously-running web with a coating liquid, the method comprising the steps of: applying a plenty of the coating liquid on the web to form a coating layer on the web; and removing a surplus of the coating liquid from the coating layer with a rod, the rod being in contact with the coating layer and being rotated in a reverse direction with respect to a running direction of the web, wherein an absolute value of $V_1/V_2$ is set between 0.0001 and 0.06, where $V_1$ (cm/sec) is a rotating speed of the rod and $V_2$ (cm/sec) is a running speed of the web.

According to the present invention, in the coating method using the coating rod, the coating is performed by rotating the coating rod in the reverse direction with respect to the running direction of the web, and setting the absolute value of $V_1/V_2$ between 0.0001 and 0.06. This prevents the formation of the streaks even if the high-speed coating is performed by raising the running speed of the web or if the coating liquid with a high viscosity is applied on the web. This enables the satisfactory coating at a low speed and a high speed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of the present invention will be described hereinbelow with reference to the accompanying drawings.

Figure 1:
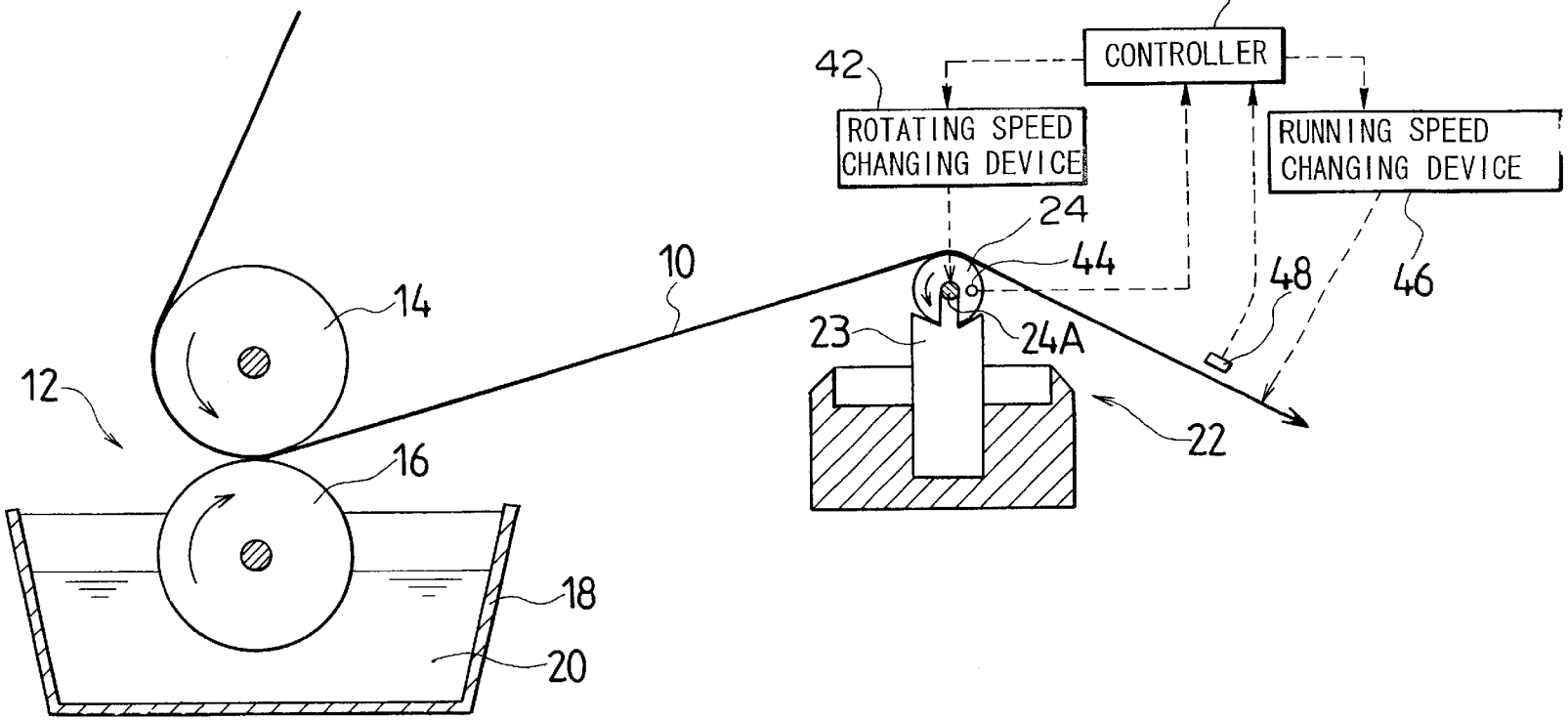
FIG. 1 is a block diagram showing a first embodiment of a coating apparatus to which the coating method of the present invention is applied.

FIG. 1 shows the structure of the first embodiment of a coating apparatus, to which a coating method of the present invention is applied. This coating apparatus removes, by a coating rod, a surplus of a coating liquid that has been applied on a web.

The coating apparatus comprises: a roll coater 12, which applies a plenty of a coating liquid 20 on a web 10 to form a coating layer on the web 10; a rod coater 22, which removes the surplus of the coating liquid 20 from the coating layer on the web 10; and a controller 40, which controls a running speed of the web 10 and a rotating speed of a coating rod 24 relatively to each other.

The roll coater 12 has a backup roller 14, which is arranged at the upper side, and an application roller 16, which is arranged at the lower side. The rotation of the application roller 16 causes the roll coater 12 to pick up the coating liquid 20 from a coating liquid pan 18. The picked-up coating liquid 20 is transferred to and applied on the web 10, which is running in the state of being supported by the backup roller 14. The roll coater is used in this embodiment as the applicator for applying the plenty of the coating liquid on the web; however, the present invention should not be restricted to this, and various kinds of coating apparatuses can be used arbitrarily as the applicator.

The rod coater 22 has the coating rod 24, which is rotated in the reverse direction with respect to the running direction of the web 10, and a supporting member 23, which rotatably supports the coating rod 24 so as to prevent the coating rod 24 from bending. A rotary shaft 24A of the coating rod 24 is connected to a rotating speed changing device 42, which is capable of changing the rotating speed $V_1$ (cm/sec) of the coating rod 24. A tachometer 44 for measuring the rotating speed of the coating rod 24 is provided in close proximity to the rotary shaft 24A.

A transporting device (not illustrated) for transporting the web 10 is provided with a running speed changing device 46, which is capable of changing the running speed $V_2$ (cm/sec) of the web 10. A non-contact type running speed meter 48 for measuring the running speed of the web 10 is provided in close proximity to the web 10. Values measured by the tachometer 44 and the running speed meter 48 are transmitted to the controller 40.

The controller 40 compares the rotating speed $V_1$ of the coating rod 24, which is transmitted from the tachometer 44, with the running speed $V_2$ of the web 10, which is transmitted from the running speed meter 48. The controller 40 controls the rotating speed changing device 42 and the running speed changing device 46 so that an absolute value of $V_1/V_2$ can be between 0.0001 and 0.06. The reason why the absolute value of $V_1/V_2$ is used is that a speed vector in which the coating rod 24 rotates is opposite to a speed vector in which the web 10 runs because the coating rod 24 rotates in the reverse direction with respect to the running direction of the web 10.

There will now be described a coating method of the present invention, which is applied to the first embodiment of the coating apparatus that is constructed in the above-mentioned manner.

As shown in FIG. 1, the roll coater 12 applies the plenty of the coating liquid 20 on the web 10, which is running in a direction indicated by an arrow, to form the coating layer on the web 10. The web 10, which has been coated with the plenty of the coating liquid 20, runs to the rod coater 22 so that the coating layer on the web 10 can be brought into contact with the rotating coating rod 24 before the coating liquid 20 of the coating layer dries and sets. The coating rod 24 thereby removes the surplus of the coating liquid 20 from the web 10 to thus adjust the amount of the coating liquid 20 remaining on the web 10. The amount of the coating liquid to be removed can be changed according to the depth, the width, the pitch and the like of a plurality of grooves formed on the coating rod 24.

The reason why the coating rod 24 is rotated in the reverse direction with respect to the running direction of the web 10 is as follows. When the coating rod 24 is rotated in the same direction as the running direction of the web 10; the running speed of the web 10 increases, the viscosity of the coating liquid 20 increases, and the surface tension of the coating liquid 20 decreases in an area where the web 10 is in contact with the coating rod 24. Accordingly, streaks are easily formed at a constant pitch on the surface of the coating layer on the web 10. To address this problem, the coating rod 24 is rotated in the reverse direction with respect to the running direction of the web 10 in order to prevent the formation of the streaks at the constant pitch, which are formed when the coating rod 24 is rotated in the same direction as the running direction of the web 10.

Even if the coating rod 24 is rotated in the reverse direction with respect to the running direction of the web 10, however, streaks of a different kind from those formed in the case where the coating rod 24 is rotated in the same direction as the running direction of the web 10 are formed on the surface of the coating layer on the web 10 if the high-speed coating is performed by raising the running speed of the web 10. Thus, only the reverse rotation cannot completely prevent the formation of the streaks.

To solve this problem, the coating method according to the present invention coats the web by rotating the coating rod 24 in the reverse direction with respect to the running direction of the web 10, and setting the absolute value of $V_1/V_2$ between 0.0001 and 0.06, where $V_1$ (cm/sec) is the rotating speed of the coating rod 24 and $V_2$ (cm/sec) is the running speed of the web 10. More specifically, the tachometer 44 measures the rotating speed $V_1$ of the coating rod 24, and sends the measured value to the controller 40. The running speed meter 48 measures the running speed $V_2$ of the web 10, and sends the measured value to the controller 40. Then, the controller 40 controls the rotating speed changing device 42 and the running speed changing device 46 according to the measured values so that the absolute value of $V_1/V_2$ can be between 0.0001 and 0.06. Preferably, the running speed $V_2$ of the web 10 is set first according to the type of the web 10, the characteristics of the coating liquid 20, and the like, and then the rotating speed $V_1$ of the coating rod 24 is adjusted so that the absolute value of $V_1/V_2$ can be between 0.0001 and 0.06.

The reason why the absolute value of $V_1/V_2$ is set between 0.0001 and 0.06 is as follows. If the absolute value of $V_1/V_2$ is more than 0.06, the reverse rotating speed of the coating rod 24 is too high with respect to the running speed of the web 10. Therefore, the streaks of a different kind from those formed in the case where the coating rod 24 is rotated in the same direction as the running direction of the web 10 are formed at a constant pitch. On the other hand, if the absolute value of $V_1/V_2$ is less than 0.0001, the reverse rotation of the coating rod 24 is not effective. Therefore, the streaks of the same kind as those formed in the case where the coating rod 24 is rotated in the same direction as the running direction of the web 10 are formed. Since there is a shift in the range of the absolute value of $V_1/V_2$ depending on kinds of the web 10 and the characteristics of the coating liquid, the absolute value of $V_1/V_2$ is preferably between 0.0003 and 0.05, and more preferably between 0.0005 and 0.03.

If the coating is performed while the coating rod 24 is rotated in the same direction as the running direction of the web 10, the sign of the formation of the streaks starts appearing when the capillary number, which is represented by $\mu \times V_2 \sigma$ where $\mu$ (cP) is the viscosity of the coating liquid and $\sigma$ (dyne/cm) is the surface tension of the coating liquid, exceeds 0.025. The streaks are recognized when the capillary number exceeds 0.1. In short, the streaks are easily formed if the capillary number is in excess of 0.025.

Even if the capillary number is in excess of 0.025, the coating can be performed without forming the streaks by rotating the coating rod 24 in the reverse direction with respect to the running direction of the web 10, and setting the absolute value of $V_1/V_2$ between 0.0001 and 0.06. Thus, properly setting the absolute value of $V_1/V_2$ not only prevents the formation of the streaks during the high-speed coating, which cannot be prevented only by the reverse rotation of the coating rod 24, but also prevents the formation of the streaks even if the capillary number is in excess of 0.025.

Consequently, the coating method of the present invention enables the satisfactory coating without the formation of the streaks even if the high-speed coating is performed by increasing the running speed of the web 10 or if the web 10 is coated with the coating liquid 20 with a high viscosity.

Figure 2:
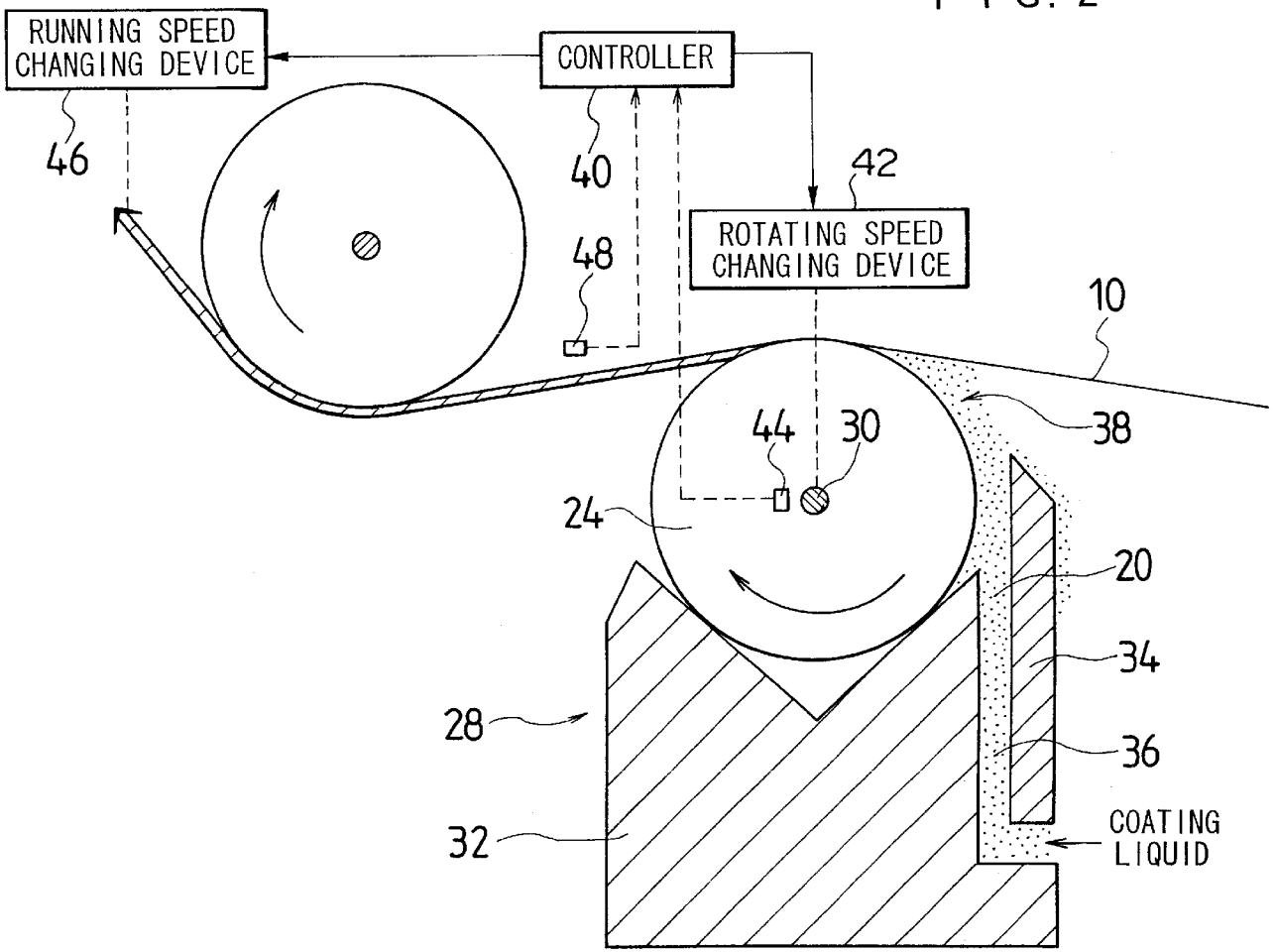
FIG. 2 is a block diagram showing a second embodiment of a coating apparatus to which the coating method of the present invention is applied.

FIG. 2 shows the structure of the second embodiment of a coating apparatus, to which the coating method of the present invention is applied. This coating apparatus applies the coating liquid on the web 10 and adjusts the amount of the coating liquid by one coating rod 24.

As shown in FIG. 2, the coating rod 24 of the present invention is disposed along the width of the web 10 so that the running web 10 becomes into contact with the coating rod 24. The coating rod 24 is supported on a rod supporting member 32 rotatably about a rotary shaft 30. The rod supporting member 32 prevents the coating rod 24 from bending, and supplies the coating liquid 20 to the coating rod 24. The rotary shaft 30 of the coating rod 24 is connected to the rotating speed changing device 42, which is capable of changing the rotating speed $V_1$ (cm/sec) of the coating rod 24. The tachometer 44, which measures the rotating speed of the coating rod 24, is provided in close proximity to the rotary shaft 30.

A transporting device (not illustrated) for transporting the web 10 is provided with the running speed changing device 46, which is capable of changing the running speed $V_2$ (cm/sec) of the web 10. The non-contact type running speed meter 48 for measuring the running speed of the web 10 is provided in close proximity to the web 10. Values measured by the tachometer 44 and the running speed meter 48 are transmitted to the controller 40.

The controller 40 compares the rotating speed $V_1$ of the coating rod 24, which is transmitted from the tachometer 44, with the running speed $V_2$ of the web 10, which is transmitted from the running speed meter 48. The controller 40 controls the rotating speed changing device 42 and the running speed changing device 46 so that an absolute value of $V_1/V_2$ can be between 0.0001 and 0.06.

There will now be described the coating method of the present invention, which is applied to the second embodiment of the coating apparatus that is constructed in the above-mentioned manner.

The coating liquid 20 is supplied into a coating liquid supply channel 36, which is formed between the rod supporting member 32 and a dam member 34. The supplied coating liquid 20 then forms a pool 38 of the coating liquid 20 in the area where the web 10 becomes into contact with the coating rod 24. Then, the rotation of the coating rod 24 causes the coating liquid 20 in the pool 38 to be transferred to and applied on the web 10. At this time, the amount of the coating liquid 20 is measured in the area where the web 10 becomes into contact with the coating rod 24 so that only a desired amount of the coating liquid 20 can remain on the web 10. The surplus of the coating liquid 20 flows down to rejoin the pool 38, to which a new coating liquid 20 is also supplied.

In the coating method according to the second embodiment, the coating is performed by rotating the coating rod 24 in the reverse direction with respect to the running direction of the web 10, and setting the absolute value of $V_1/V_2$ between 0.0001 and 0.06, where $V_1$ (cm/sec) is the rotating speed of the coating rod 24 and $V_2$ (cm/sec) is the running speed of the web 10.

This enables the satisfactory coating without forming the streaks on the surface of the coating layer on the web as is the case with the first embodiment. Thus, the coating method of the present invention enables the satisfactory coating without forming the streaks even if the high-speed coating is performed by increasing the running speed of the web or if the coating liquid with a high viscosity is applied on the web.

A variety of rods can be used as the coating rod 24 for use in the coating apparatus that executes the coating method of the present invention. For example, it is possible to use a coating rod with a smooth surface, a so-called wire rod in which a wire is wound onto a smooth rod surface, and a so-called grooved rod in which a rod surface is grooved in a variety of ways. The diameter of the coating rod is preferably between 3 mm and 100 mm.

The diameter of the wire rod is between 4 mm and 100 mm, and more preferably between 6 mm and 30 mm. Setting the diameter of the wire rod at more than 100 mm is not desirable since longitudinal streaks are easily formed on the surface of the coating layer on the web 10. If the diameter of the wire rod is less than 4 mm, it is difficult to manufacture the coating rod 24. The diameter of the wire on the wire rod is preferably between 0.05 mm and 1.0 mm, and more preferably between 0.07 mm and 0.4 mm. If the diameter of the wire is more than 1.0 mm, too much of the coating liquid is applied on the web 10, which is not preferable for the coating method that is effective for the high-speed thin-film coating. If the diameter of the wire is less than 0.05 mm, it is difficult to manufacture the wire rod by winding the wire around the rod, and the wire tends to break. The wire is ordinarily made of metal. The best material for the wire is stainless steel in view of the corrosion resistance, the abrasion resistance, the strength and the like. To improve the abrasion resistance, the surface of the wire is preferably plated, particularly with hard chromium.

The grooved rod is manufactured by cutting, laser machining, rolling or the like. The grooves are preferably formed at a pitch of between 0.05 mm and 0.7 mm, and more preferably between 0.1 mm and 0.5 mm. The sectional form of the grooved rod is preferably close to a sine curve, but the sectional form should not be restricted to this. The grooved rod may have another sectional form.

Ordinarily, it is easier to manufacture a sample of the wire rod than a sample of the grooved rod. The grooved rod and the wire rod, which are manufactured in a variety of ways, are suitable for applying the same amount of the coating liquid under the same conditions if areas per unit length in spaces below a line connecting the summits of convex parts in the section of the rods are equal. According to this relationship, the grooved rod can be grooved properly on the basis of the sample of the wire rod. The grooved rod is preferably made of metal in view of the corrosion resistance, the strength and the like. The best material for the grooved rod is stainless steel.

The rod supporting member, which supports the coating rod in the first and second embodiments, should be made of a material with a small friction resistance between the rod supporting member and the rod (a wire in the case of the wire rod). More specifically, the rod supporting member is made of a fluororesin, a polyacetal resin, a polyethylene resin, a polystyrene resin, and the like. Among these materials, polytetrafluoroethylene known as Teflon (a trademark of DuPont in the U.S.) or the polyacetal resin known as Derlin (a trademark of DuPont in the U.S.) are particularly suitable for the material of the rod supporting member in view of the friction coefficient and the strength. The dam member of the second embodiment is preferably made of the same material as the coating rod. The rod supporting member may be made of the resin material with an additive such as glass fiber, graphite and molybdenum disulfide. Preferably, the friction coefficient between the rod supporting member and the rod is lowered by coating or attaching the resin material on the surface of the rod supporting member after the rod supporting member is made of the metal material. Alternatively, the rod supporting member may be made of various metal materials impregnated with the above-mentioned resin materials; for example, aluminum impregnated with polytetrafluoroethylene.

The type of the coating liquid 20 for use in the coating method of the present invention should not particularly be restricted. Examples of the coating liquid 20 are an aqueous solution or an organic solution of a macromolecular compound, a pigmentary solution and a colloidal solution. The viscosity of the coating liquid is preferably between 0.8 cP and 1000 cP, and more preferably between 2 cP and 500 cP. The surface tension of the coating liquid is preferably between 20 dyne/cm and 70 dyne/cm, and more preferably between 30 dyne/cm and 50 dyne/cm.

The web for use in the coating method of the present invention may be either band-shaped or sheet-shaped. The web can be made of paper, plastic film, resin coated paper, an aluminum sheet, an iron sheet, synthetic paper, and the like. The plastic film is made of polyolefin such as polyethylene and polypropylene; vinyl polymer such as polyvinyl acetate, polyvinyl chloride and polystyrene; polyamide such as 6, 6-nylon and 6-nylon; polyester such as polyethylene terephthalete and polyethylene-2, 6-naphthalete; polycarbonate; cellulose acetate such as cellulose triacetate and cellulose diacetate; and the like. A typical resin for the resin coated paper is polyolefin such as polyethylene, but should not be restricted to this. The thickness of the web 10 is not particularly restricted, but the thickness of the web 10 is preferably between about 0.01 mm and 1.0 mm in view of the easy of use and the flexibility.

According to the present embodiments, the rotating speed changing device 42, the tachometer 44, the running speed changing device 46 and the running speed meter 48 are provided so that $V_1/V_2$ can be changed arbitrarily; however, these devices 42 and 46 and meters 44 and 48 are not necessary if $V_1/V_2$ is fixed at one set value between 0.0001 and 0.06.

EXAMPLES

There will now be described the comparison between examples of the present invention, in which the coating rod is rotated in the reverse direction with respect to the running direction of the web in the coating apparatus in FIG. 1, and some comparative examples.

In the examples and the comparative examples, the coating liquid was comprised of an acrylic copolymer of 8 wt. %, a methyl glycol of 58 wt. % and a methanol of 30 wt. %, and had the viscosity of 12.1 cP and the surface tension of 31 dyne/cm. The web was an aluminum substrate with a thickness of 0.3 mm and a width of 1000 mm, and was transported at the running speed $V_2$ of 10000 cm/min. A wire rod was used as the coating rod, in which a wire with a thickness of 0.6 mm was wound around a rod with a thickness of 10 mm.

In the example 1, the coating rod was rotated at the rotating speed of about 33 cm/min (10 rotation/min) in the reverse direction with respect to the running direction of the web. At this time, the absolute value of $V_1/V_2$ was 0.0033, so that the absolute value of $V_1/V_2$ could be between 0.0001 and 0.06 according to the present invention.

In the example 1, no streak was formed on the surface of the coating layer on the web.

In the comparative example 1, the coating rod was rotated at the rotating speed of 33 cm/min (10 rotation/min) in the same direction as the running direction of the web. In other words, the rotating speed of the coating rod satisfied the condition of the present invention, but the rotating direction was reversed with respect to that of the present invention.

In the comparative example 1, streaks of the same kind as the streaks at a constant pitch, which would be formed in the case where the coating rod is rotated in the same direction as the running direction of the web, were formed on the surface of the coating layer on the web.

In the comparative example 2, the coating rod was rotated at the rotating speed of 660 cm/min (200 rotation/min) in the reverse direction with respect to the running direction of the web. At this time, the absolute value of $V_1/V_2$ was 0.066, so that the absolute value of $V_1/V_2$ could be more than the upper limit of the range between 0.0001 and 0.06 according to the present invention.

In the comparative example 2, streaks of a different kind from the streaks at a constant pitch, which would be formed in the case where the coating rod is rotated in the same direction as the running direction of the web, were formed at a constant pitch of about 0.8 mm on the surface of the coating layer on the web. The reason for this was considered to be that the rotating speed of the coating rod was too high with respect to the running speed of the web.

In the comparative example 3, the coating rod was rotated at the rotating speed of 0.66 cm/min (0.2 rotation/min) in the reverse direction with respect to the running direction of the web. At this time, the absolute value of $V_1/V_2$ was 0.00007, so that the absolute value of $V_1/V_2$ could be lower than the lower limit of the range between 0.0001 and 0.06 according to the present invention.

In the comparative example 3, many streaks of substantially the same kind as the streaks at a constant pitch, which would be formed in the case where the coating rod is rotated in the same direction as the running direction of the web, were formed on the surface of the coating layer on the web along the width of the web. The reason for this was considered to be that the reverse rotation of the coating rod was not effective since the rotating speed of the coating rod was too low with respect to the running speed of the web.

Therefore, the coating method of the present invention enables the satisfactory coating without forming the streaks on the surface of the coating layer on the web.

As set forth hereinabove, the coating method of the present invention enables the satisfactory coating without forming the streaks on the surface of the coating layer on the web if the high-speed coating is performed by raising the running speed of the web or if the coating liquid with a high viscosity is applied on the web.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method for coating a continuously-running web with a coating liquid, the method comprising the steps of:

applying an excess of the coating liquid on the web to form a coating layer on the web. and removing a surplus of the coating liquid from the coating layer with a rod, the rod being in contact with the coating layer and being rotated in a reverse direction with respect to a running direction of the web, wherein $\mu \times V_2/\sigma$ is at least 0.025 and, an absolute value of $V_1/V_2$ is set between 0.0001 and 0.06, where $\mu$(cP) is a viscosity of the coating liquid, $\sigma$ (dyne/cm) is a surface tension of the coating liquid, $V_1$ (cm/sec) is a rotating speed of the rod and $V_2$ (cm/sec) is a running speed of the web.

2. The coating method as defined in claim 1, wherein the excess of the coating liquid is applied on the web with the rod in the applying step.

* * * * *